United States Patent [19]

Evans

[11] Patent Number: 4,531,633

[45] Date of Patent: Jul. 30, 1985

[54] RELATING TO LATCH SECURITY DEVICES

[76] Inventor: Leighton D. Evans, 50 Neath Rd., Maesteg, Glamorgan, United Kingdom

[21] Appl. No.: 416,957

[22] Filed: Sep. 9, 1982

[30] Foreign Application Priority Data

| | | | |
|---|---|---|---|
| Sep. 9, 1981 | [GB] | United Kingdom | 8127296 |
| May 28, 1982 | [GB] | United Kingdom | 8215637 |
| Jun. 8, 1982 | [GB] | United Kingdom | 8216572 |
| Jul. 31, 1982 | [GB] | United Kingdom | 8222173 |

[51] Int. Cl.[3] ..... B65D 69/00

[52] U.S. Cl. ..... 206/230; 206/231; 292/346

[58] Field of Search ..... 206/230, 231; 229/87 H; 292/346

[56] References Cited

U.S. PATENT DOCUMENTS

| | | | |
|---|---|---|---|
| 941,877 | 11/1909 | Horsch | 292/346 |
| 1,431,869 | 10/1922 | Bergen | 206/231 |
| 1,727,323 | 9/1929 | Bartlett | 292/346 |
| 2,230,719 | 2/1941 | Guild | 206/231 |
| 2,796,281 | 6/1957 | Philpott | 292/346 |
| 3,279,840 | 10/1966 | Barone | 292/346 |
| 3,416,650 | 12/1968 | Mortensen | 206/230 |
| 3,895,834 | 7/1975 | Grinbaum et al. | 292/346 |
| 4,199,060 | 4/1980 | Howard | 206/231 |

*Primary Examiner*—Joseph Man-Fu Moy

*Attorney, Agent, or Firm*—Young & Thompson

[57] ABSTRACT

A latch security kit comprising a pair of templates for positioning at predetermined positions respectively on a door and door jamb adjacent the door latch and staple, the templates indicating the positioning of studs to be affixed to the door and door jamb so that the studs will be mutually interspersed when the door is closed onto the jamb, and a set of studs to be inserted in the position defined by the templates.

19 Claims, 18 Drawing Figures

RELATING TO LATCH SECURITY DEVICES

There is a problem with standard latch-type locks in that it is possible to spring them from the outside by manipulating a piece of plastic through the gap between the door and the door jamb to which the lock is fitted. Such illegal opening of the latch-type lock can be carried out quite simply unless the locking catch (if present) has been pressed down to fix the bolt of the latch-type lock in its outer position. Obviously locking of the bolt will not be carried out by a householder leaving a house or by a guest leaving a hotel room, since otherwise he would be unable to release the lock with the key.

It is an object of this invention to provide a security device which will render it virtually impossible for latch-type locks to be sprung by the method discussed above.

Accordingly, this invention provides a latch security kit comprising a pair of templates for positioning at predetermined positions respectively on a door and door jamb adjacent the door latch and staple, the templates indicating the positioning of studs to be affixed to the door and door jamb so that the studs will be mutually interspersed when the door is closed onto the jamb, and a set of studs to be inserted in the positions defined by the templates.

When using such a kit positions for the studs will be determined by use of the templates and once the studs are fixed into the door and door jamb they will then overlap from both sides of the gap between the door and the door jamb in such a way that it will now be impossible for a sheet of plastic to be manipulated into the gap towards the bolt of the lock.

The templates could be simple paper sheets with markings thereon indicating the positions for insertion of the studs. Once the studs are in position the paper plates can be torn away.

In one preferred arrangement the templates comprise a mounting arrangement for the studs themselves, thus reducing the number of steps required in positioning and fixing the studs in the door and door frames. For example, the templates may provide mountings for the studs which will be held at the required positions of the stud to be affixed to the door and door jamb, the mountings enabling the templates to be pulled away from studs which have been partially affixed. Furthermore, the two templates providing the mountings for the studs could be part of a single unit. The studs could also carry packing pieces (washers), ready mounted on the shanks of the studs, for a predetermined width of gap to be filled between a door and door jamb.

Another possibility is to provide the templates as one or two sheets having washers or other packing pieces secured at a sheet edge by short spurs which can readily be broken to enable the sheet to be removed when the packing pieces have been secured to the door or door jamb in desired positions by the studs.

In one preferred embodiment, the studs are headed pins or screws presenting non-sharp edges when inserted in a door or door jamb. As an alternative the studs could carry fingers which will interlock when in position on a door closed onto its door jamb. Another possibility is to provide that the studs are angled plates provided with fixing pins or screws such that the angled surfaces of the studs will overly one another when in position on a door closed onto its door jamb. Where the studs are to be secured to a metal door or to metal plates on the door or the door jamb, the studs may be in the form of rivets to be secured in the metal plate or door in the conventional way, such as by using a rivet gun.

Of course the gap between the door and the door jamb may vary from door to door. Thus although studs can be provided which will substantially fill the gap of a recognised standard width, for gaps of larger width the necessary filling can be achieved by including in the kit packing pieces to be held by and behind the studs enabling the stud height above the door or door jamb to be varied in incremental steps. For hotels and the like where the user will be fitting the security device to a large number of doors, it may be of advantage to provide the studs with the packing pieces (washers) ready mounted on the shanks of the studs for a predetermined width of gap between a door and door jamb. The user then only needs to measure the gap with a feeler gauge and choose a kit having studs with pre-mounted packing pieces which are suitable for the width of the gap measured. The studs suitable for a particular gap width could be fixed into the sides of a thick piece of card, ready to be removed for immediate use.

Another possibility is to provide studs with heads of different sizes. A particularly preferred form of stud will have a portion depending from the head towards the tip of the shank, this portion being of a predetermined length. Such studs can then be provided with depending portions having lengths which vary from stud to stud and can therefore be used for gaps of varying widths. In the preferred form the extending portion is of annular form, thus leaving an internal recess surrounding the shank.

Preferably, there will also be included in the kit a feeler gauge for determining the width of the gap between a door closed onto its jamb, to enable the desired stud height to be calculated. The feeler gauge could be calibrated to indicate the number of packing pieces or the stud head thickness which would be needed to fill a gap of a particular width.

The kit may additionally incorporate a metal plate to be driven into a portion of a wooden door jamb so as to resist entry of a spike or other tool which may be used in an attempt to tamper with the door lock or the door surround. This plate will advantageously incorporate tangs which will tend to hold the plate within the woodwork against extraction.

The invention also extends to a latch security device comprising two plates to be carried respectively by a door and a door jamb at predetermined positions and carrying raised portions which will be mutually interspersed when the door is closed onto the jamb.

Since this device is ready made for fixing to the door and door jamb, separate studs are of course not needed although packing strips could be provided for insertion behind the plates to enable gaps of different widths to be catered for.

The invention may be performed in various ways and preferred embodiments thereof will now be described with reference to the accompanying drawings, in which:-

FIG. 5 illustrates the provision of packing pieces enabling a gap of large width to be catered for;

Figure 1:
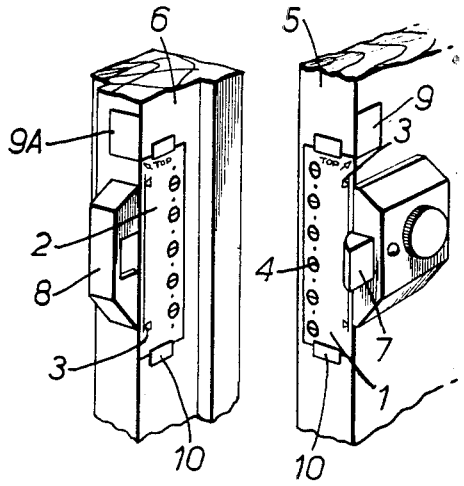
FIG. 1 illustrates parts of a door and a door jamb to be fitted with a latch security device of this invention.

Two templates 1 and 2 shown in FIG. 1 may be formed from card or metal and carry location arrows 3 and markings 4 indicating the centre fixing points for studs to be attached to a door 5 and door jamb 6. The two templates 1 and 2 are respectively positioned on the edges of the door 5 and door jamb 6 so that arrow markings 3 are aligned with the top edge of the lock casing 7 and the staple 8. Precise positioning of these templates is achieved by positioning a piece of card provided with the kit above the lock casing 7 and then fixing a sticky strip 9 in line with the top of that card onto the door 5. The door is then closed so that a portion 9A of the sticky strip 9 will stick to the door jamb 6 whereupon the strip 9 is cut through. The strip portions 9 and 9A then indicate the mounting positions for the top edges of the templates 1 and 2 which are held by adhesive tape portions 10. The studs are now driven partially home through the marking points 4 and then the templates will be torn away and the studs will be driven fully home. Alternatively a spike may be inserted through a hole in the centre of each marking 4 so as to punch holes in the door and door jamb indicating positions where studs will subsequently be driven in.

Figure 4:
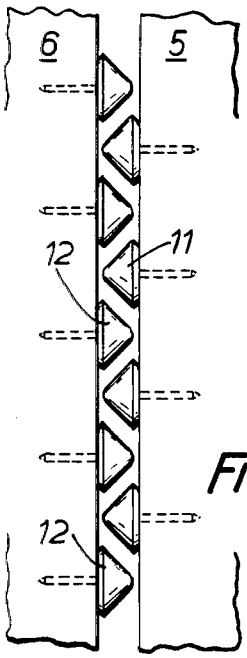
FIG. 4 illustrates the appearance in side view of studs fixed onto the door and door jamb in positions indicated by the templates.

When all the studs have been fixed into the door and door jamb and the door is closed, the studs will be mutually interspersed so as to overlap in the manner illustrated by the studs shown in FIG. 4. The studs 11 are carried by the door 5 whilst the studs 12 are carried by the door jamb 6. It will be appreciated that anyone attempting to slide a plastic sheet into the gap between the door 5 and the door jamb 6 will be thwarted by the studs 11 and 12 which provide a tortuous path which cannot be followed by a sheet of plastic of the necessary rigidity to be able to spring the bolt of the latch which is hidden behind the array of studs.

Figure 5:
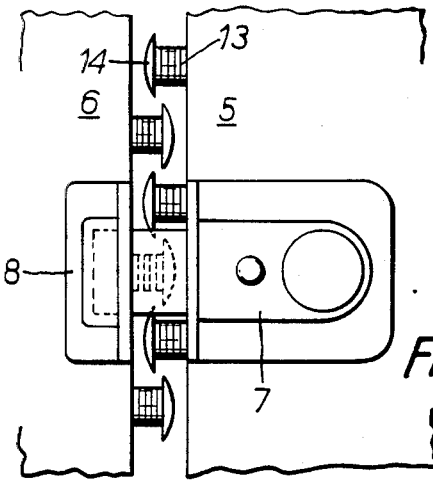

As illustrated in FIG. 5, if the gap between the door 5 and the door jamb 6 is large, then packing pieces or washers 13 (ideally formed from vulcanised fibrous material) can be positioned behind the head 14 of each stud and about the shank which will be driven into the woodwork. In this case the studs have simple rounded heads as shown.

Figure 6:
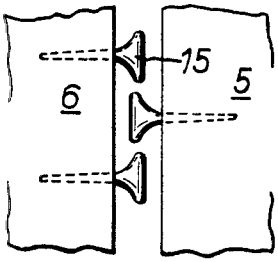
FIGS. 6 to 9 illustrate various possible alternative forms of studs which may be employed.
Figure 7:
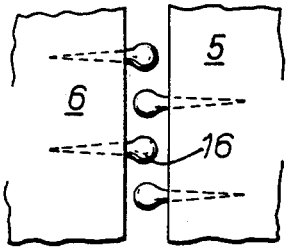
Figure 8:
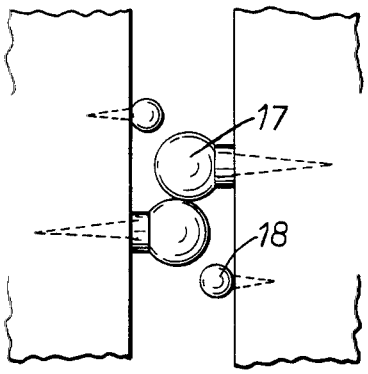
Figure 9:
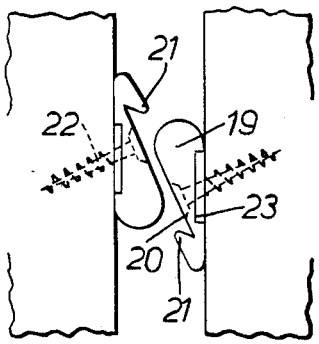

It is an important feature that the shape of the studs should be such that they will not leave any sharp edges which could catch on clothes or fingers and cause damage when the door is open. Thus the studs will be formed with smooth surfaces and non-sharp edges. Two possible alternative forms of simple studs 15 and 16 are illustrated in FIGS. 6 and 7. It is possible also to utilise studs having heads of different sizes. Thus FIG. 8 illustrates studs 17 having large heads combined with studs 18 having small heads. Another possibility is to provide studs in the form of plate-like members 19 having angled surfaces 20 which will mutually overlap and also having small bosses 21 which will cause the path between the studs to be more tortuous. These plate-like members 19 are held in place by screws 22 and are provided with rear recesses 23 which will provide a location for packing pieces of varying thicknesses to take account of gaps of differing widths.

Figure 2:
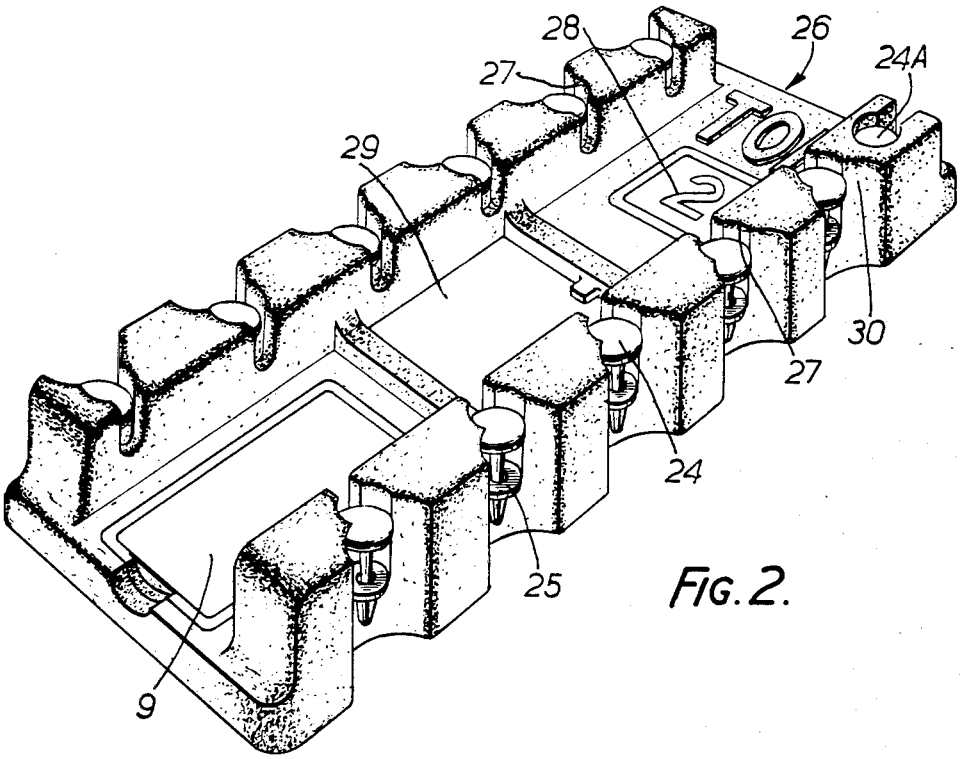
FIG. 2 is a perspective view of a mounting pack for use in fixing latch security devices of this invention.

FIG. 2 illustrates a one piece unit wherein the templates additionally provide for mounting of prepacked studs 24 having spacing washers 25 positioned thereon. The mounting unit comprises a foamed polystyrene block 26 with part-circular cross-section passageways 27 which hold the heads of the studs 24. The block will carry a number 28 indicating the gauge of the gap for which the particular kit is suited. The block 26 additionally provides a mounting for the adhesive strip 9, and for a card 29 which will be used, in the manner described in connection with FIG. 1, to determine the position of the fixing of the strip 9 above the latch casing 7 as a guide for the positioning of the template. The block 26 itself acts additionally as the two templates and thus the block will be offered up firstly, for example to the edge of the door 5 (as in FIG. 1) whereupon the studs 24 will be driven home partially. The block 26 can then be pulled away from the studs 24 which pass out through the sides of the passages 27 which are exposed by the cut-out portions 30. The block 26 will then be used to mount the studs 24 in a similar manner to the door jamb 6.

The block 26 also incorporates a mounting position for a spare stud 24A, in case an extra one is needed. The block can of course be formed from any convenient material, such as vacuum formed plastics.

Figure 3:
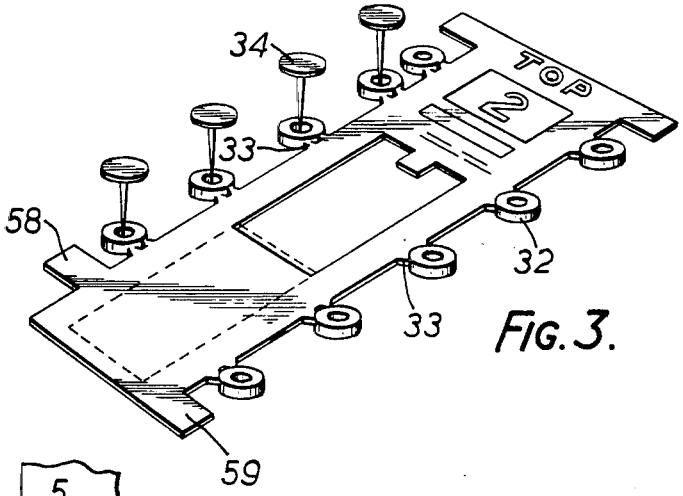
FIG. 3 is a perspective view of a form of template for use in fixing the latch security device of this invention.
Figure 10:
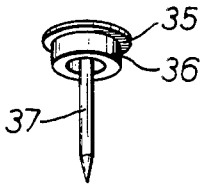
FIGS. 10 and 11 are respectively a perspective view of one preferred form of stud and cross-sectional views through a series of studs.
Figure 11:
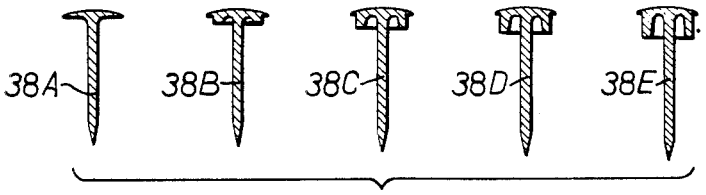

The template 31 shown in FIG. 3 is formed from a moulded plastics material and incorporates plastics washers 32 held by short spurs 33. The template 31 can be positioned either on the door or the door jamb so that one of the rows of washers 32 can be fixed in place by pins 34 as illustrated. The template can then be loosely worked relative to the washers 32 so that the template breaks away, The type of stud shown in FIGS. 10 and 11 has a circular head 35 from which depends an annular spacer portion 36 surrounding the shank 37 of the stud. A set of studs can be formed, as illustrated in FIG. 11, providing head and extension portion combinations which will fill the gap between a door and a door jamb of an approximate width of from 1 mm for the stud 38A up to 5mm for the stud 38E. Of course other methods of providing studs with progressively increasing head sizes may be employed.

Figure 12:
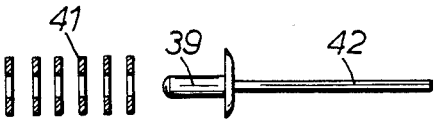
FIG. 12 illustrates a metal rivet for use with a metal door.
Figure 13:
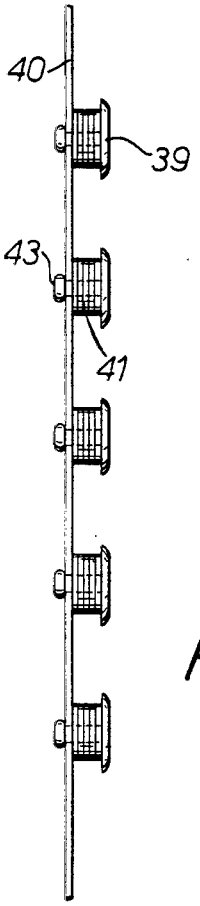
FIG. 13 shows a number of metal rivets secured to a metal panel of a door.

For metal doors or doors incorporating metal plates in the region of the bolt mechanism it may be difficult or impossible to drive home and secure ordinary pins. FIGS. 12 and 13 therefore illustrate a method of inserting the rivets 39 to a desired depth in the metal plate 40, the thickness of the gap to be closed being determined by the number of washers 41 used. The rivets 39 will be supplied on a rod 42 which will be acted on by a rivet gun so as to compress the tip 43 of the rivet to hold it in place behind the metal plate 40. Of course instead of a series of washers 41, a single washer of a desired thickness can be used and these washers can be provided, for example, in the form illustrated in FIG. 3.

Figure 14:
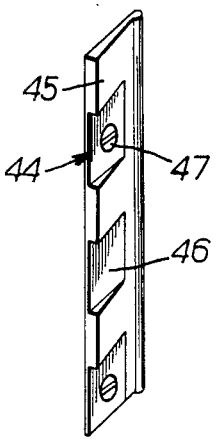
FIGS. 14 and 15 illustrate two forms of latch security plates of this invention.
Figure 15:
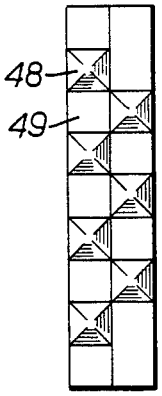
Figure 16:
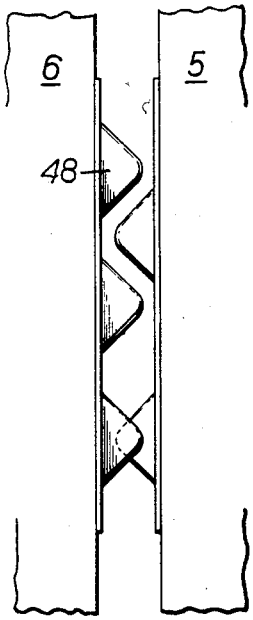
FIG. 16 shows in side view the overlap of bosses formed by plates of the type shown in FIG. 15 when fixed to a door and door jamb.

As an alternative to providing a kit which enables studs to be inserted at predetermined positions, an individual plate could be provided for attachment to each of the door and the door jamb. One type of plate of this sort is illustrated in FIG. 14. The plate 44 has wedge shaped raised portions 45 which between them form the gaps 46 which will receive similar wedge portions on the other plate which is attached to the other part of the door and door jamb combination. These plates 44 will be fixed into the woodwork by screws 47. Another form of single plate security device is shown in FIG. 15 and carries raised bosses 48 defining between them gaps 49 which on the one side will receive similar bosses on the other plate carried by the other part of the door and door jamb combination. FIG. 16 illustrates how these bosses 48 might overlap when the door is shut. Packing piece strips can be provided to lie behind the plate-like security devices shown in FIGS. 14 and 15 where large gaps between the door and the door jamb have to be filled.

Figure 17:
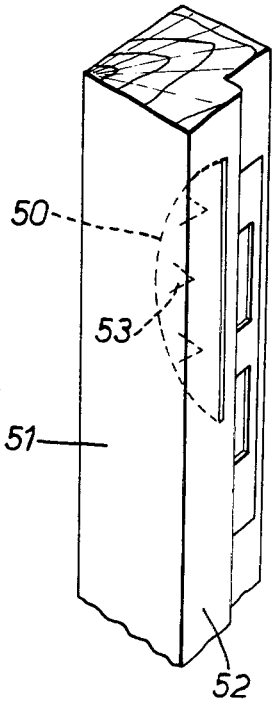
FIG. 17 illustrates a portion of a door jamb provided with a metal plate.
Figure 18:
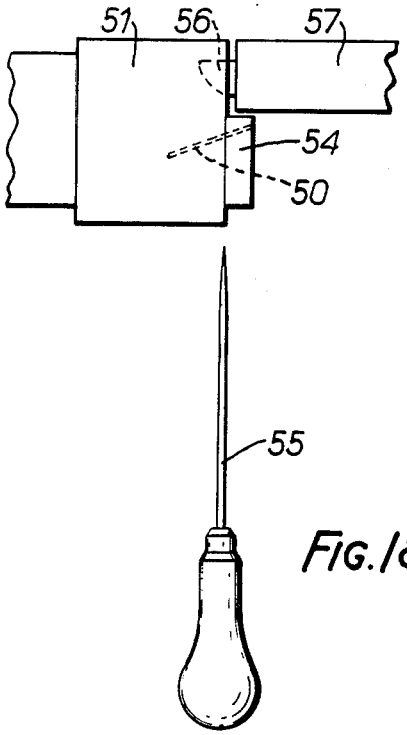
FIG. 18 is a cross-section through the door jamb of FIG. 17.

FIGS. 17 and 18 illustrate how a metal plate 50 can be inserted into a portion of a door jamb 51 defining an architrave 52. A slot of sufficient width to receive the plate 50 will be cut into the woodwork by a jigsaw or a circular saw. The plate 50 is then driven home and projecting flanges 53 will tend to hold the plate within the woodwork against extraction. Then if anyone attempts to lever off a portion of the woodwork defining the architrave such as a door stop strip 54 (FIG. 18) using a metal spike 55, the metal plate 50 will prevent the spike from passing straight through and thus allowing a portion of the woodwork to be levered away to provide ready access to the bolt 56 of a door lock 57. The plate 50 is driven in at an angle so that when the door is closed it is difficult, if not impossible, for the plate 50 to be levered out as it will foul against the door. This aspect can be improved by inserting the plate 50 to project through the edge of the strip 54 which faces the door 57.

The moulded template shown in FIG. 3 incorporates a further feature, namely, the staggered flanges 58 and 59 at the bottom end. These enable further sets of pins 34 to be inserted into a door if a longer area is to be covered. Thus the template will be offered up so that the flanges 58 and 59 rest on the uppermost staggered pair of washers 32 and a further set of pins can be driven in through the washers carried by the second template.

I claim:

1. A latch security kit comprising a pair of templates for positioning at predetermined positions respectively on a door and door jamb adjacent the door latch and staple, the templates indicating the positioning of studs to be affixed to the door and door jamb so that the studs will be mutually interspersed when the door is closed onto the jamb, and a set of studs to be inserted in the positions defined by the templates.

2. A kit according to claim 1, wherein the templates are paper sheets and markings are produced on the paper sheets indicating the positions for insertion of the studs.

3. A kit according to claim 1, wherein the templates comprise a mounting arrangement for the studs.

4. A kit according to claim 3, wherein the templates provide mountings for the studs to ensure that the studs will be held at the required positions of each stud to be affixed to the door and door jamb, the mountings enabling the templates to be pulled away from studs which have been partially affixed.

5. A kit according to claim 3, wherein short spurs are provided at edges of the templates and packing pieces are secured by the short spurs to the templates so as to be readily broken away to enable the template to be removed when the packing pieces have been secured to the door or door jamb by the studs.

6. A kit according to claim 1, wherein the two templates providing the mountings for the studs are formed as a single unit.

7. A kit according to claim 1, wherein the studs are in the form of heads carried by shanks, the heads presenting non-sharp edges when inserted in a door or door jamb.

8. A kit according to claim 1, wherein fingers are formed on the studs, which fingers will interlock when in position on a door closed onto its door jamb.

9. A kit according to claim 1, wherein the studs are in the form of angled plates provided with fixing members for insertion into the door or door jamb, the plates being such that the angled surfaces of the studs will overly one another when in position on a door closed onto its door jamb.

10. A kit according to claim 1, wherein the studs are in the form of rivets.

11. A kit according to claim 1, including packing pieces to be held by and behind the studs enabling the stud height beyond the door or door jamb edge to be varied in incremental steps.

12. A kit according to claim 11, wherein the studs have the packing pieces ready mounted on the shanks of the studs.

13. A kit according to claim 12, wherein the studs with the packing pieces are fixed into the sides of a thick piece of card, ready to be removed for immediate use.

14. A kit according to claim 1, wherein each stud has a portion depending from the head towards the tip of the shank, this portion being of a predetermined length.

15. A kit according to claim 4, wherein the extending portion is of annular form, thus defining an internal recess surrounding the shank.

16. A kit according to claim 1, including a feeler gauge for determining the width of the gap between a door closed onto its jamb, to enable the desired sud height to be calculated.

17. A kit according to claim 16, wherein the feeler gauge is calibrated to indicate the number of packing pieces or the stud head thickness which would be needed to fill a gap of a particular width.

18. A kit according to claim 1, including a metal plate to be driven into a portion of a wooden door jamb so as to resist entry into the wooden portion of a spike or other tool.

19. A kit according to claim 18, wherein the plate incorporates tangs which will tend to hold the plate within the woodwork against extraction.

* * * * *